US005920960A

United States Patent [19]

Klüting

[11] Patent Number: 5,920,960

[45] **Date of Patent: *Jul. 13, 1999**

[54] DOOR LOCK FOR MOTOR VEHICLE DOORS

[75] Inventor: Bernd-Alfred Klüting, Radevormwald, Germany

[73] Assignee: E.D. Scharwächter GmbH & Co, KG, Remscheid, Germany

[ * ] Notice: This patent is subject to a terminal disclaimer.

[21] Appl. No.: 08/987,345

[22] Filed: Dec. 9, 1997

[30] Foreign Application Priority Data

Dec. 10, 1996 [DE] Germany ..... 296 21 382

[51] Int. Cl.[6] ..... E05D 11/10

[52] U.S. Cl. ..... 16/334; 16/330; 16/322

[58] Field of Search ..... 16/334, 330, 328, 16/329, 331, 332, 352, 353, 312–314, 299, 300, 321, 322

[56] References Cited

U.S. PATENT DOCUMENTS

| | | | |
|---|---|---|---|
| 1,078,002 | 11/1913 | Schrey | 16/334 |
| 1,159,529 | 11/1915 | Parizek | 16/334 |
| 4,829,633 | 5/1989 | Kassner | 16/322 |
| 5,173,993 | 12/1992 | Baker | 16/329 |
| 5,408,726 | 4/1995 | Kent | 16/326 |

*Primary Examiner*—Chuck Y. Mah

*Attorney, Agent, or Firm*—Anderson, Kill & Olick, P.C.

[57] ABSTRACT

A door lock for motor vehicle doors, including a door retaining part provided with brake cams or brake ramps and fixedly secured to one of two door assembly parts, a door and a door pillar, a braking and locking assembly cooperating with the door retaining part, fixedly secured to another of the two door assembly parts and including a plurality of braking bodies cooperating with the brake cams or brake ramps, and braking and locking force-applying element arranged between the door retaining part and the braking and locking assembly, with the door retaining part, the braking and locking assembly and the force-applying element being formed as separate structural components.

17 Claims, 4 Drawing Sheets

DOOR LOCK FOR MOTOR VEHICLE DOORS

BACKGROUND OF THE INVENTION

1. Field of the Invention

The present invention relates to a door lock for motor vehicle doors and including a door retaining part provided with brake cams or brake ramps and fixedly secured to one of two door assembly parts, a door or door pillar, a braking and locking assembly cooperating with the door retaining part and fixedly secured to another of the two door assembly parts, the braking and locking assembly including a plurality of braking bodies cooperating with the brake cams or brake ramps, and braking and locking force-applying element arranged between the door retaining part and the braking and locking assembly.

2. Description of the Prior Art

A conventional door lock for motor vehicle doors, as a rule, includes a door retaining part, in particular, a door retaining rod and a braking and locking device which cooperates with the door retaining part. The braking and locking device has at least one braking body and a pressure spring for biasing the braking body against the door retaining part. The door retaining part usually, as discussed above, the door retaining rod is operatively connected with one of door assembly parts and is rotatable about an axis, which extends parallel to the axis of the door hinge. The braking and locking device is usually located in a retaining housing secured to another one of the door assembly parts. With the door lock described above, it is always necessary that the braking body and the biasing spring form a single unit mountable in the retaining housing. Because with the conventional construction of the door lock, the retaining housing should be adapted to the specific construction of a respective braking body and the specific shape of the biasing spring, it is impossible to make a door lock, which would meet the requirements of a particular application, from pre-fabricated structural components. Rather, for all conventional motor vehicle door locks, other than those in which cooperating with each other indexing segment and torsional spring are used, and independent of whether a door lock is formed integrally with a door hinge or separately from a door hinge, a separate housing is produced for each door lock even when only another cross-section of the braking body and another spring force of the biasing spring are necessary.

For a particular type of a motor vehicle door lock, one which is formed integrally with a door hinge, it was proposed to form the braking and locking bodies as rolling bodies rotatable about support axles, which extend perpendicular to the hinge axis, and cooperating with a retaining element which is fixedly secured to a hinge half in which the hinge pin extends with a running fit, with the retaining element being formed as at least particularly circular track concentric with respect to the hinge axis and being provided with index or detent marks in a form of axially extending indentations. The rolling bodies are biased into an engagement with the index marks by a spring supported against a free end of the hinge pin. The index marks are provided in an end surface of a flange forming the track. The described construction of a door lock results in a structure that has reduced dimensions, occupies less space, and can be economically produced. At the same time, the door lock door hinge assembly is characterized by a substantially noiseless operation. However, the drawback of the above-described construction consists in that with each change of the shape or the operation of one of the components of the door lock, a totally new construction of the door lock is required which at least in majority of cases, excludes the use of standardized parts or structural components. In all of the conventional and known constructions of door locks, a rather unfavorable tolerance pairing between corresponding elements of a door lock and, in particular between a retaining housing and elements located therein can be observed. An unfavorable tolerance pairing can result in that a door could not be retained in its exact predetermined braking and locking positions and/or with a sufficient braking and locking force.

Accordingly, an object of the present invention is to provide a motor vehicle door lock that can be adapted to different operational requirements such as braking force, rising rate of the braking force, and the like.

Another object of the present invention is a door lock the manufacture of which is based on a unit assembly system according to which the door lock is produced form pre-fabricated structural components.

SUMMARY OF THE INVENTION

These and other objects of the present invention which will become apparent hereinafter, are achieved by forming the door retaining part, the braking and locking assembly, and the biasing force-applying element as separate components.

The separation of functional elements of a motor vehicle door lock in replaceable structural components permits to adapt the door lock to different requirements of particular cases by replacing one or a pair of components which are arranged one beneath the other. In particular, e.g., by replacing the biasing force-applying component, with other structural components remaining the same, a greater braking and locking force can be achieved. By replacing, e.g., the door retaining component, a greater or smaller rate of increase of the braking and locking force can be provided. In addition, the separation of the functional parts of a door lock in separate pre-fabricated structural components provides a possibility to convert a pure mechanical door lock in a simple way, by replacing a single component, into a power-actuated, if necessary, controlled door lock. Thus, the force applying component can be replaced with a controlled electrical, pneumatic or hydraulic power unit.

The separation of the functional parts or elements of a motor vehicle door lock in separate components is suitable for all types of door locks in which a pressure force is applied to braking bodies for biasing them into engagement with door retaining parts provided with braking ramps or the like.

According to the present invention, the braking and locking component can be formed of a plurality of braking bodies and a cage for receiving the braking bodies, with the cage being provided with at least one connection surface for connecting the cage with another structural component. The force applying component can be formed of a two-part housing having means for connection with one of the door assembly parts and at least one connection surface for connecting the housing with another structural component with the two housing parts being axially displaceable relative to each other, with pressure-applying means being received in the housing. The connection surfaces of the force-applying component and of the braking and locking component can be provided with complementary connection elements which form, upon assembly of the door lock, a form-locking connection of both components. Naturally, other means for connecting the two parts can be used if, in particular cases, using the other means will prove to be advantageous. E.g., both components can be connected by welding.

When a pure mechanical door lock is produced, the force applying component can include at least one and, if necessary, more placed one into another, pressure springs, preferably, helical springs extending between the two housing parts. The power-actuated means can include a power-actuated expansion element, e.g., a bellows, a cylinder, and can include also an electrical control element.

When elongate braking bodies need be used, their integration in a pre-fabricated component does not impose any limitations. Therefore, the braking bodies of the braking nd locking component can be formed as rolling bodies which are supported in the cage in a particular manner, in particular, in a tilted position.

The door retaining component can be formed advantageously as a shaped part connectable with one of the door assembly part, and can be conventionally formed as a door retaining rod, track or the like.

In a particular type of a door lock, one which is formed integrally with a detachable door hinge one half of which is secured to one of two door assembly parts, a door or a door pillar, and another half of which is secured to another one of the two door assembly parts, with the two hinge halves being pivotally connected with a hinge pin which is received in the one hinge half with a running fit and is fixedly received in the another hinge half, the door retaining part is fixedly secured to the one hinge half and has an annular track formed concentrically with respect to a longitudinal axis of the hinge. The braking and locking assembly of this door lock comprises at least two braking bodies rotatable about respective axles extending transverse to a hinge axis. The force-applying element comprises a two-part housing having one of its parts supported on the hinge pin and another of its parts associated with the braking and locking assembly. A pressure spring is received in the two-part housing and acts on the braking and locking assembly via the another housing part. The annular cage for receiving the braking bodies can be formed of a stamped sheet metal and has a U-shaped cross-section. The braking bodies are formed as a rolling bodies rotatable about respective axles fixedly secured in opposite legs of the cage and extending transverse to an axis of a hinge with which the door lock is to be integrally formed. According to a particularly preferred embodiment of the present invention, the cage can be formed, when a relatively thin sheet metal material is used, so that both its legs, which support the braking bodies, have double walls to provide for a reliable stationary support of axles which support the braking bodies formed as rolling bodies. E.g. the axles can be provided with an appropriately shaped profile at one of their ends to be retained in at least one of the two cage legs. In particular, the axles can be provided at their respective ends with knurling.

To facilitate mounting of the braking bodies and/or their supporting axles in the cage, at least one of the two cage legs can be provided with a groove-like opening.

According to the present invention, the force-applying component includes a two-part housing for receiving force-applying element formed as a pressure spring, preferably as a helical spring, with one of the housing parts being formed of a stamped sheet metal pot-shaped part, and the other housing part being formed as an abutment plate secured to the hinge pin with a nut. At that, the one and the other housing parts can have cooperating projections and openings which connect the two housing parts with a possibility of an axial displacement of the two parts relative to each other but prevent their rotation relative to each other.

For connection of the force-applying component with the braking and locking component during the assembly of a door lock, according to a preferred embodiment of the present invention, the pot-shaped housing part has a bottom having a shape surface complementary to the back surface of the cage which has also a U-shape. For a simple and reliable connection of the cage with the housing of the force-applying component, a form-locking connection therebetween is contemplated. To this end the bottom of the pot-shaped housing part and the back surface of the U-shaped cage can be provided with complementary axial projections and corresponding openings.

Besides form-locking connection of adjacent components, other methods of connection can be used. Thus, the bottom of the pot-shaped housing part and the back surface of the U-shaped cage can have complementary locating surfaces, with the two components being connected by welding. With this type of connection, in order to achieve a maximum stability of the connection and an axial alignment of both components, advantageously, the bottom of the pot-shaped housing is provided with a collar which engages from behind the inner leg of the U-shaped cage.

With a particular type of a door lock, one that is formed integrally with a detachable door hinge, it is necessary to provide an appropriate sealing in the region of the bottom of the pot-shaped housing adjacent to the hinge pin of the hinge and to insure a maintenance-free extension of the hinge pin through the bottom. To this end, according to the invention, the bottom of the pot-shaped housing part of the housing of the force-applying component is provided with a central opening through which the hinge pin extends, with the hinge pin being received in a sleeve which is formed of a bearing maintenance-free material and being mounted in the central opening of the housing bottom. The sleeve has a radial flange which abuts the inner surface of the bottom and supports the force-applying spring. However, an embodiment in which the sleeve does not have a flange, and the bottom is provided with a coating layer, preferably, of bearing maintenance-free material is also possible.

Finally, in this type of the door lock, according to the present invention, an end surface of the door retaining part can be provided, at its end remote from the track, with a recess in which a washer insert, which surrounds the hinge pin, and a needle bearing are located.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
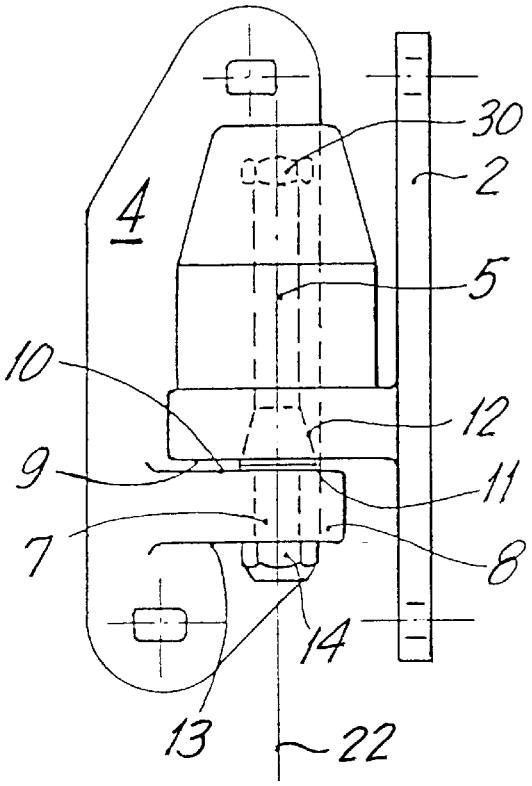
FIG. 1 shows a side view of a door hinge formed integrally with a door lock according to the present invention.
Figure 2:
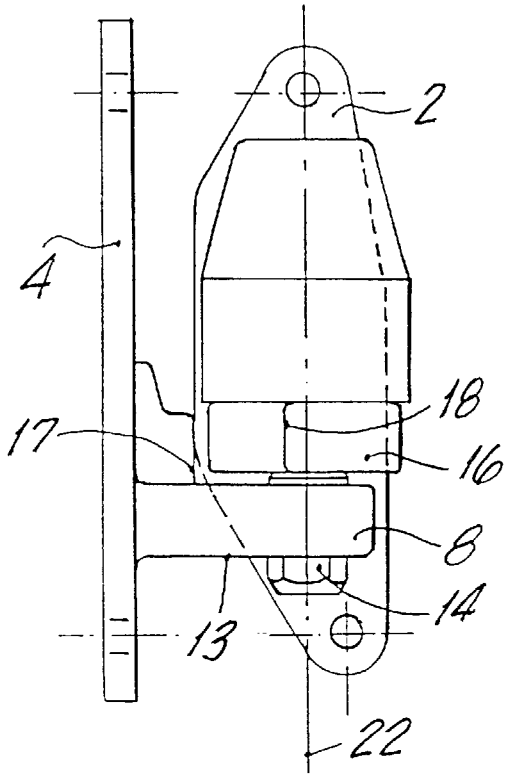
FIG. 2 shows an end view of the door hinge shown in FIG. 1.
Figure 3:
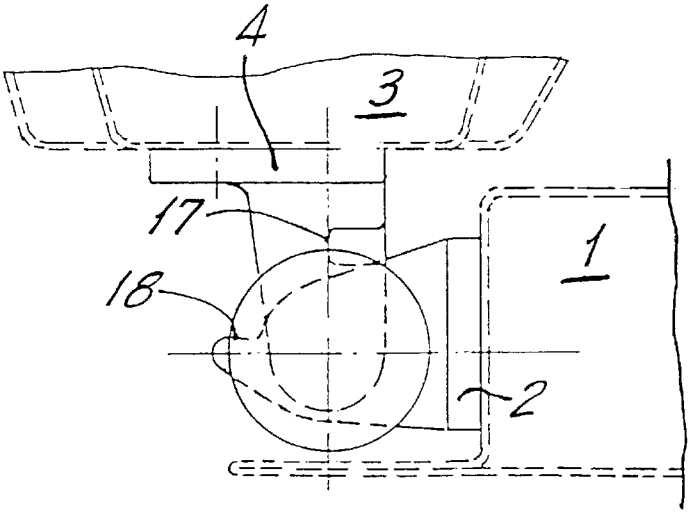
FIG. 3 shows a plan view of the door hinge shown in FIGS. 1–2.

A separable door hinge is formed of a first hinge half 2, which is connected with one element 1 of a door assembly, a door or a door pillar, a second hinge half 4, which is connected with another element 3 of the door assembly, and a hinge pin 5 which pivotally connects the first 2 and second 4 hinge halves together. The hinge pin 5 is rotatably supported in the first hinge half 2 with a bearing sleeve 6 which is made of a maintenance-free material and through which the hinge pin 5 extends with a running fit. In the other hinge half 4, in the assembled condition of the hinge, the hinge pin 5 is fixedly form-lockingly secured in a gudgeon 16 of the second hinge half 4 with radially extending means for joint rotation with the hinge half 4. The hinge pin 5 is secured from being lifted of the gudgeon bore with thread means 14 which engages an outer surface 13. The thread means 14 is formed by a nut which is screwed onto a thread provided on the free end of the hinge pin 5. The hinge pin 5 has a collar 11 which is located between adjacent radial surfaces of both hinge halves 2 and 4. The collar 11 is engaged, on its side adjacent to the radial surface of the first hinge half 2, with a cone 12 which tapers toward the free end of the hinge pin 5 and which is located in a complementary conical opening provided in the first hinge half 2. Two stops 17 and 18, which are provided on the two hinge half 4 and 2 respectively, limit the maximum allowable opening angle of the hinge.

A door lock according to the present invention, which is formed integrally with the door hinge and is shown in the drawings, consists of three structural components, namely, of a door retaining part which is provided with brake ramps and which forms a first structural component, a cage for braking bodies and which forms a second structural component, and helical spring means which apply a clamping or pressure force to the braking bodies and which forms a third structural component.

Figure 5:
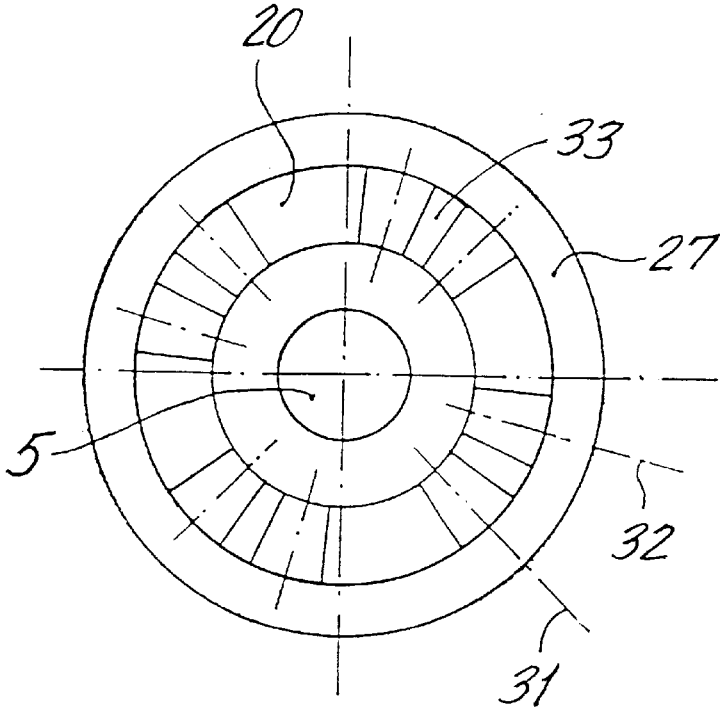
FIG. 5 shows a plan view of a door retaining part of a door lock according to the present invention which is formed integrally with the door hinge.
Figure 6:
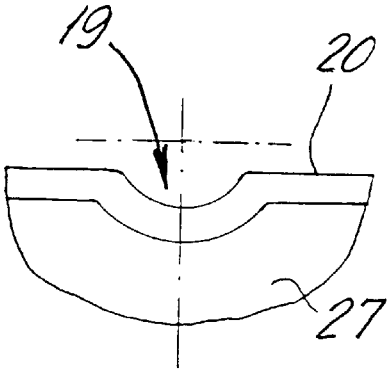
FIG. 6 shows a partial view of the door retaining part shown in FIG. 5.
Figure 7:
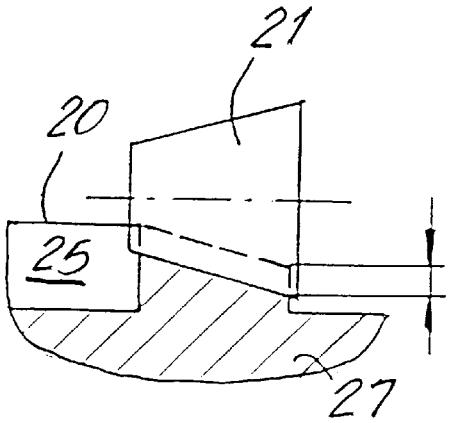
FIG. 7 shows a partial view of a detail of the door retaining part of FIGS. 5–6.

In the embodiment shown in the drawing, the door retaining part, which is provided with brake ramps, is formed as a locking disc 27. The locking disc 27 is fixedly connected with the first hinge half 2 with cylindrical pins 26 which are arranged concentrically with respect to the axis of the hinge pin 5. The locking disc 27 has a track 20 which is formed on an end surface of a raised collar 25 and which is provided with the braking ramps. The track 20 is inclined toward the outer circumference of the locking disc 27. The brake ramps in the track 20 are formed by grooves 19, as shown in FIG. 6. As shown in FIG. 5, the grooves 19 are arranged in opposite pairs with respect to the axis of the hinge pin 5, with front and rear detents 31 and 32 forming a free angle 33 therebetween.

Figure 4:
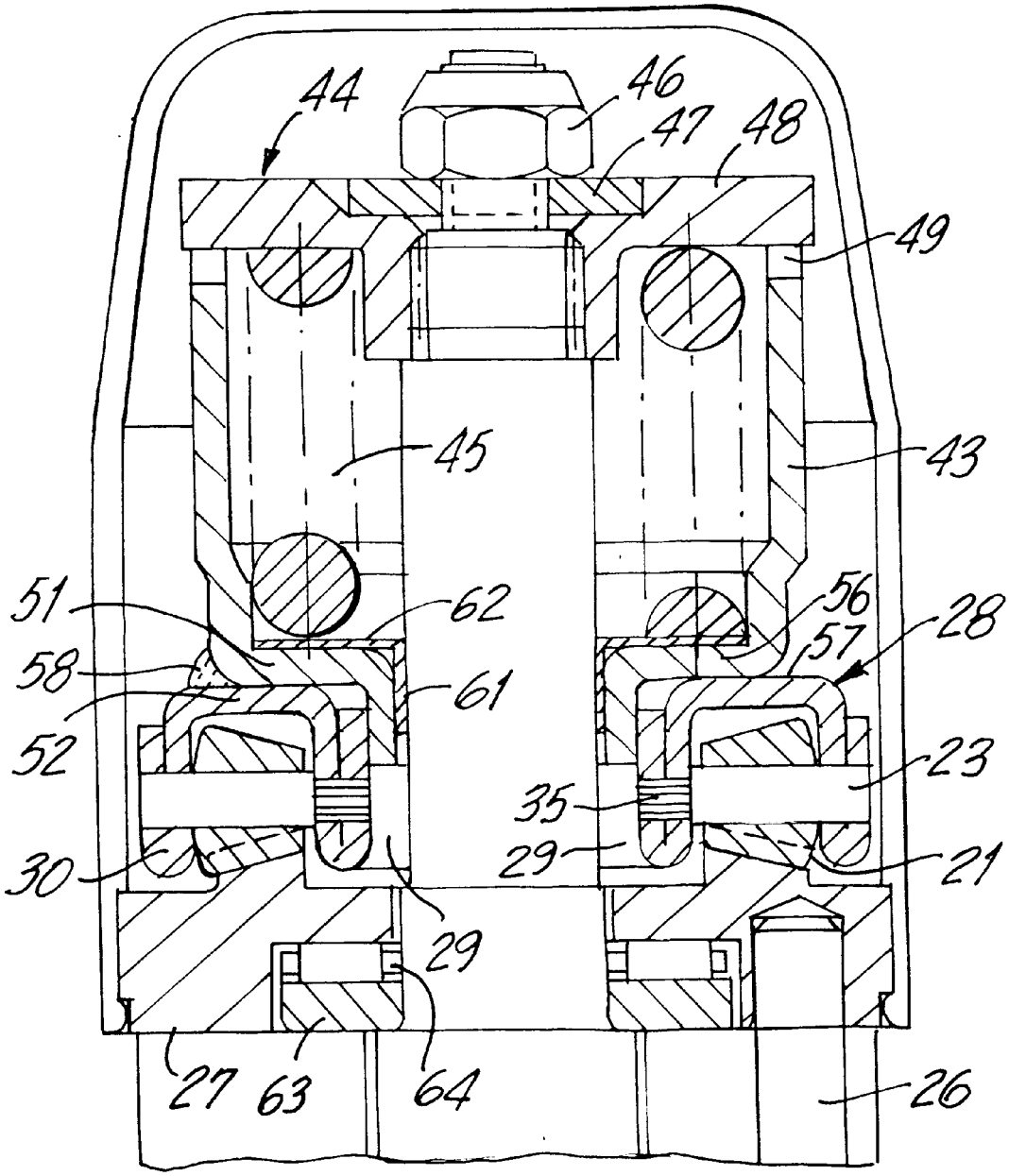
FIG. 4 shows a longitudinal cross-sectional view of a first embodiment of a door lock according to the present invention and which is formed integrally with the door hinge.

Braking bodies 21, which cooperate with the track 20, are formed as conical rollers with a cone angle corresponding to the inclination of the track 20. The braking bodies 21, the conical rollers, rotate about respective axles 23 and are received in an annular cage 28. The cage 28 is formed of stamped sheet metal blank and has a U-shaped cross-section. The axles 23, which support the braking bodies 21, are fixedly secured in both legs 29 and 30 of the cage 28. An advantageous embodiment of the cage 28 is shown in FIG. 4. As shown in FIG. 4, the cage 28 is formed of a relatively thin sheet metal material, with both legs 29, 30 being formed of double walls, whereby a reliable support is provided for the axles 23 of the braking bodies 21, without any possibility of rotation of the axles 23 in their supports. The axles 23 are further secured in the inner leg 29 against rotation with knurlings 35 provided on the circumference of each of the axles 23 and are supported in the outer leg 30 of the cage 28 in a slot opening 36.

The structural component, which forms the pressure application means, includes a housing formed of two-parts 43, 44 and a pressure spring 45 received in the housing. The first housing part 43, which houses the pressure spring 45, which is formed as a helical spring, is formed of a pot-shaped stamped sheet metal part. The second housing part 44 is formed as an abutment plate 48 which is supported on the hinge pin 5 and is secured thereto with a washes insert 47 and a nut 46. The pot-shaped housing part 43 is form-lockingly connected with the second housing part 44. To this end, the first housing part 43 is provided with a plurality of axial recesses 49 in its upper end surface, which are form-lockingly engage in respective, somewhat trapezoidally-shaped openings 50 provided in the second housing part 44. At that, the depth of the recesses 49 exceeds the thickness of the plate-shaped second housing part 44 at least by a height of a brake ramp of the track 20.

Figure 8:
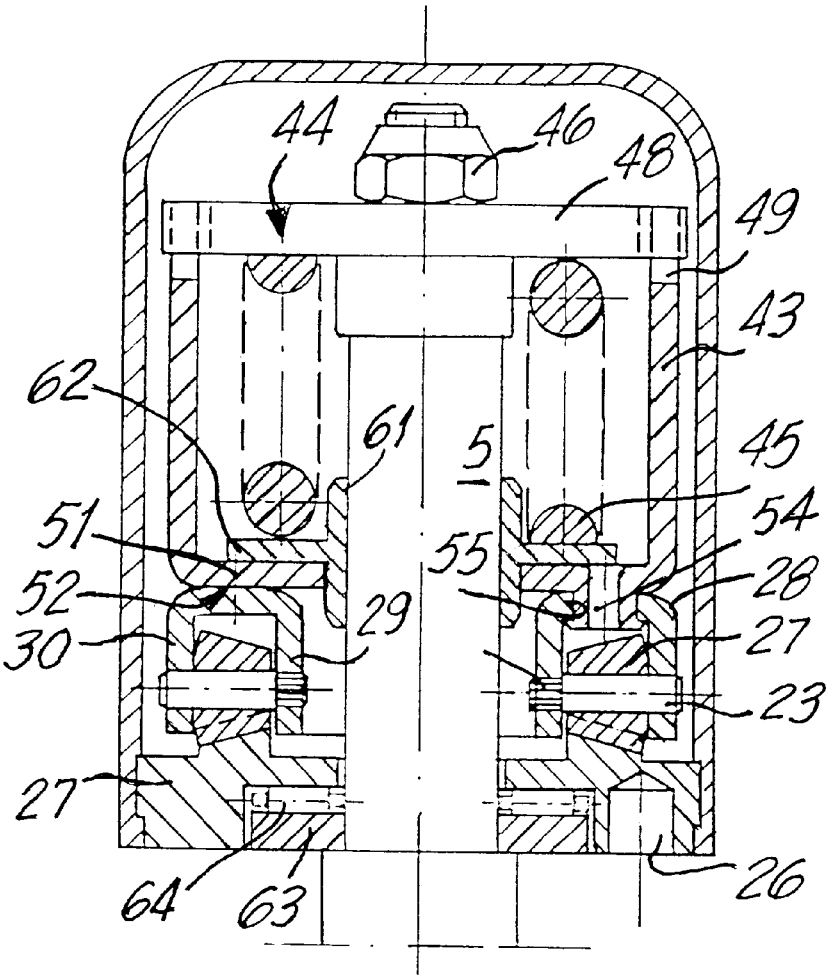
FIG. 8 shows a longitudinal cross-sectional view of a second embodiment of a door lock according to the present invention and which is formed integrally with the door hinge.
Figure 9:
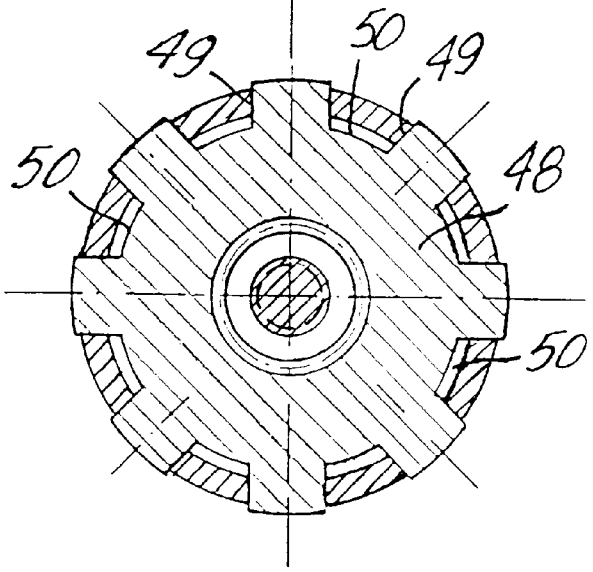
FIG. 9 shows a plan cross-sectional view of a door lock assembly, which is formed integrally with the door hinge and forms a device for generating of a clamping force.

In the embodiment shown in FIG. 8, the bottom 51 of the pot-shaped first housing part 43 has a circular shape, which coincides with the outer back surface 52 of the base of the U-shaped cage 28. The bottom 51 and the back surface 52 have complementary axial projections 54 and openings 55 engageable with each other.

In the embodiment shown in FIG. 4, the bottom 51 of the pot-shaped first housing part 43 and the back surface 52 of the cage 28 have complementary locating surfaces 56 and 57 and are connected with each other with a weld 58. The bottom 51 of the pot-shaped first housing part 43 is provided with a collar 60 which engages the inner leg 29 of the U-shaped cage 28 from behind.

For sealing and, simultaneously, for maintenance-free positioning of the two-part housing with respect to the hinge pin 5, the bottom 51 of the housing is formed with a central opening in which a sleeve 61 formed of a bearing maintenance-free material is located, with the pin 5 extending through the sleeve 61. The sleeve 61 is provided with a radial projection 62 which overlies the bottom 51 and supports the pressure spring 45.

The locking disc 27 is provided the end surface thereof remote from the track 20, with an annular recess which surrounds the hinge pin 5. An annular washer 63 and a needle bearing 64 are located in this recess.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A motor vehicle door lock for use with a motor vehicle door hinge having two hinge halves connectable, respectively, with two parts of a door assembly, a door and a door pillar, and pivotally connected with each other by a hinge pin which is received in one hinge half with a running fit and is fixedly received in another hinge half, the door lock comprising:

a door retaining part provided with one of brake cams and brake ramps and fixedly secured to the one hinge half;

braking and locking means cooperating with the door retaining part and including a plurality of braking bodies cooperating with the one of brake cams and brake ramps; and means for applying a braking and locking force between the door retaining part and the braking and locking means, wherein the braking and locking means and the force applying means are supported on the hinge pin, wherein the door retaining part, the braking and locking means, and the force-applying means are formed as separate structural components, wherein the braking and locking means comprises a plurality of braking bodies, and a cage for receiving the braking bodies, the cage having a connection surface associated with one of the door retaining part and the force applying means, and wherein the cage is formed of a stamped sheet metal and has a U-shaped cross-section, and the braking bodies are formed as a rolling bodies rotable about respective axles fixedly secured in opposite legs of the cage and extendable transverse to an axis of the door hinge with which the door lock is integrally to be formed.

2. A door lock as set forth in claim 1, wherein both legs of the U-shaped cage have double walls.

3. A door lock at set forth in claim 1, wherein the axles are inserted through a slot-like opening formed in one of the legs of the U-shaped cage.

4. A door lock as set forth in claim 1, wherein the axles are fixedly secured in one of the legs of the U-shaped cage.

5. A door lock as set forth in claim 4, wherein the axles are secured in the one of the legs with knurlings provided on respective circumferential portions of the axles.

6. A motor vehicle door lock for use with a motor vehicle door hinge having two hinge halves connectable, respectively, with two parts of a door assembly, a door and a door pillar, and pivotally connected with each other by a hinge pin which is received in one hinge half with a running fit and is fixedly received in another hinge half, the door lock comprising:

a door retaining part provided with one of brake cams and brake ramps and fixedly secured to the one hinge half;

braking and locking means cooperating with the door retaining part and including a plurality of braking bodies cooperating with the one of brake cams and brake ramps;

means for applying a braking and locking force between the door retaining part and the braking and locking means, wherein the braking and locking means and the force applying means are supported on the hinge pin, wherein the door retaining part, the braking and locking means, and the force-applying means are formed as separate structural components, wherein the door retaining part has an annular track formed concentrically with respect to a longitudinal axis of the hinge, wherein the braking and locking means comprises at least two braking bodies rotatable about respective axles extendable transverse to a door hinge axis and a U-shaped cage for receiving the bodies, wherein the force-applying means comprises a two-part housing having one part thereof supported on the hinge pin and another part thereof associated with the braking and locking means, and a pressure spring received in the two-part housing and acting on the braking and locking means via the another housing part, and wherein the another housing part is formed as a stamped sheet metal pot-shaped part, and the one housing part is formed as an abutment plate securable to the hinge pin with a nut, with the one and another housing parts having cooperating projections and openings which connect the two housing parts with a possibility of an axial displacement relative to each other but prevent their rotation relative to each other.

7. A door lock as set forth in claim 6, wherein the cage is formed as a U-shaped part, and the pot-shaped housing part has a bottom having a shaped surface complementary to a back surface of the U-shaped cage.

8. A door lock as set forth in claim 7, wherein the bottom of the pot-shaped housing part and a back surface of the U-shaped cage have complementary axial projections and openings.

9. A door lock as set forth in claim 7, wherein the bottom of the pot-shaped housing part and a back surface of the U-shaped cage have complementary locating surfaces connecting with each other by welding.

10. A door lock as set forth in claim 7, wherein a bottom of the pot-shaped housing has a collar engaging from behind an inner leg of the U-shaped cage.

11. A door lock as set forth in claim 7, wherein a bottom of the pot-shaped housing parts has a central opening through which the hinge pin extends, and wherein the housing further includes a sleeve formed of a bearing maintenance-free material within which the hinge pin is received, the sleeve being mounted in the central opening and having a radial flange abutting a bottom surface and supporting the pressure spring.

12. A motor vehicle door lock for use with a motor vehicle door hinge having two hinge halves connectable, respectively, with two parts of a door assembly, a door and a door pillar, and pivotally connected with each other by a hinge pin which is received in one hinge half with a running fit and is fixedly received in another hinge half, the door lock comprising:

a door retaining part provided with one of brake cams and brake ramps and fixedly secured to the one hinge half;

braking and locking means cooperating with the door retaining part and including a plurality of braking bodies cooperating with the one of brake cams and brake ramps;

means for applying a braking and locking force between the door retaining part and the braking and locking means, wherein the braking and locking means and the force applying means are supported on the hinge pin, wherein the door retaining part, the braking and locking means, and the force-applying means are formed as separate structural components, wherein the door retaining part has an annular track formed concentrically with respect to a longitudinal axis of the hinge, wherein the braking and locking means comprises at least two braking bodies rotatable about respective axles extending transverse to a door hinge axis, wherein the force-applying means comprises a two-part housing having one part thereof supported on the hinge pin and another part thereof associated with the braking and locking means, and a pressure spring received in the two-part housing and acting on the braking and locking means via the another housing part, and wherein the door retaining part has, in an end surface thereof remote from the track, a recess, and wherein the door lock further comprises a washer insert and a needle bearing located in the recess.

13. A motor vehicle door lock for use with a motor vehicle door hinge having two hinge halves connectable, respectively, with two parts of a door assembly, a door and a door pillar, and pivotally connected with each other by a hinge pin which is received in one hinge half with a running fit and is fixedly received in another hinge half, the door lock comprising;

a door retaining part provided with one of brake cams and brake ramps and fixedly secured on the one hinge half;

braking and locking means cooperating with the door retaining part and including a plurality of braking and locking bodies cooperating with the one of brake cams and brake ramps, and a cage for receiving the seeking and locking bodies;

means for applying a braking and locking force between the door retaining part and the braking and locking means, wherein the braking and locking means and the force applying means are supported on the hinge pin, wherein the door retaining part, the braking and locking means, and the force-applying means are formed as separate structural components, and wherein the force-applying means comprising a two-part housing, with the two housing parts being axially displaceable relative to each other, means for connecting the housing with the hinge pin, and pressure-applying means received in the housing, and wherein the housing has at least one connection surface cooperating with one of door retaining part and the braking and locking means.

14. A door lock as set forth in claim 13, wherein the braking and locking means and the force-applying means have respective connection surfaces provided with complementary connection means.

15. A door lock as set forth in claim 13, wherein the pressure applying means comprises a pressure spring extending between the two housing parts.

16. A door lock as set forth in claim 13, wherein the braking bodies are formed as rolling bodies rotatable about axles fixedly secured in the cage.

17. A door lock as set forth in claim 13, wherein the braking bodies are formed as sliding bodies.

* * * * *